United States Patent [19]

York

[11] 4,030,654

[45] June 21, 1977

[54] HAMMER TOOL FOR CARPET STRIP

[75] Inventor: Alvin York, Kouts, Ind.

[73] Assignees: Eva Imogene Jefferson, Wheatfield, Ind.; Peggy Joe Koehler, Valparaiso, Ind. ; part interest to each

[22] Filed: July 22, 1976

[21] Appl. No.: 707,752

[52] U.S. Cl. ..... 227/110; 227/147

[51] Int. Cl.[2] ..... B25C 7/00

[58] Field of Search ..... 227/7, 8, 107, 110, 227/119, 140, 147

[56] References Cited

UNITED STATES PATENTS

| | | | |
|---|---|---|---|
| 2,557,000 | 6/1951 | Holmes | 227/147 |
| 3,602,419 | 8/1971 | Doberne | 227/147 |
| 3,711,008 | 1/1973 | Clifford et al. | 227/147 |

*Primary Examiner*—Granville Y. Custer, Jr.
*Attorney, Agent, or Firm*—Walter Leuca

[57] ABSTRACT

A hammer device having spaced guide runners to guide the percussion end of the device along a carpet strip to position the hammer member directly over the anchor nail of the carpet strip. The leg member of the guide runners are spring loaded so that the percussion end of the hammer device is manually pressed down against the bias of the spring to encapsulate the anchor nail so that the striking action of the hammer member drives the nail axially without damage to the adjacent barbs.

6 Claims, 5 Drawing Figures

HAMMER TOOL FOR CARPET STRIP

BACKGROUND OF THE INVENTION

1. Field of the Invention

This invention relates generally to hammer devices and more particularly to such devices adapted to nail carpet anchor strips.

2. Description of the Prior Art

The prior practice, in the art of carpet laying of the manner commonly referred to as wall to wall, is to nail a carpet anchor strip parallel and adjacent the wall against which the carpet abutts. These strips are elongated sections having a plurality of barbs upstanding from the upper surface thereof on which the edge of the carpet material is impaled when stretched thereover to abutt against the wall. These strips are also provided with nails partially imbeded in the strip and spaced along the length thereof. The strips are commercially available provided with the barbs and nails so that the workman merely lays the strips along the edge of the wall end to end and anchors them to the floor by hammering the nails into the floor. The nails provided in the strips may be masonry nails or wood nails depending upon the composition of the floor on which the carpet is to be laid. The disadvantages of the prior art to which this invention is directed are that in the nailing operation which is done manually by hammering the nails, the nails often are bent if the blows are not all direct and solid. Also, if the hammer blows are not aimed accurately, and the hammer misses the nail target, the barbs adjacent the nail will be struck, thereby bent and destroyed. Also, if the hammer swing is not tightly controlled since the strip is placed very close to the wall, the finished walls will be struck by the hammer glancing blows and consequently scratched and marred. Manually nailing the strip nails so that none of the above enumerated faults occur will require great skill and time consuming care.

SUMMARY OF THE INVENTION

Accordingly, I have invented a simple hammer device provided with guide means to guide the percussion end of the tool along the carpet strip to position the hammer member directly over the anchor nail, and further adapted to encapsulate the nail so that the striking action by the hammer member drives the nail axially without damage to the adjacent barbs.

Other objects and advantages of my invention will become more apparent after a careful study of the following detailed description taken together with the accompanying drawings which illustrate a preferred embodiment of my invention.

DESCRIPTION OF THE PREFERRED EMBODIMENT

Figure 1:
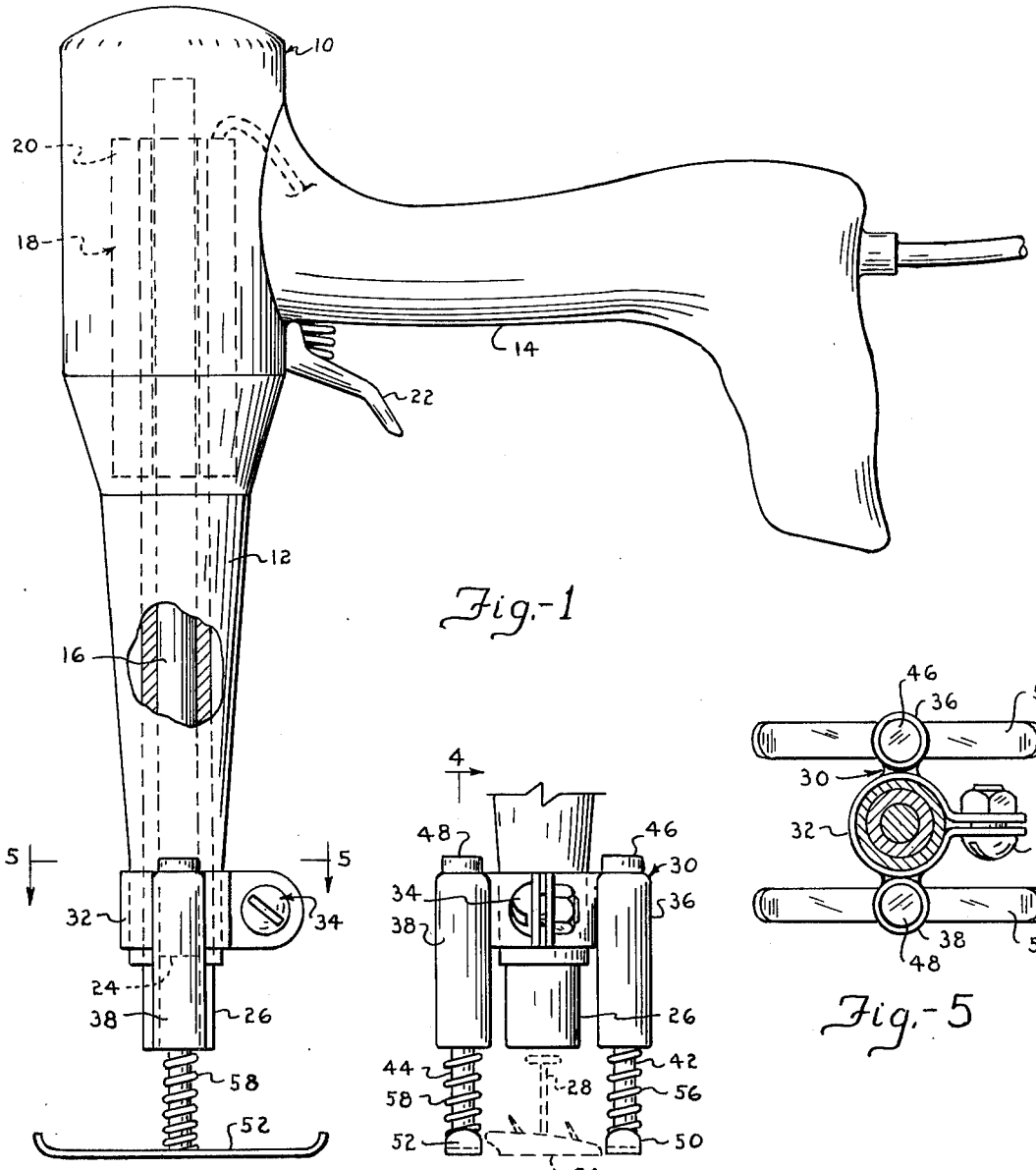
FIG. 1 is a side view of the hammer device of my invention showing a part of the housing broken away.

Referring now to the drawings wherein is illustrated the preferred embodiment of my invention, numeral 10 designates generally the hammer device of my invention. It comprises a generally elongated, narrow housing 12 formed so that the housing has no lateral projection which would abut against an adjacent wall and prevent housing 12 from being positioned perpendicular to the floor. Pistol grip 14 is provided on a side of housing 12 for manually supporting and operating my device. Housing 12 contains reciprocating hammer shaft 16, one end thereof being associated with driving means represented generally by the numeral 18 but not shown in detail since driving means 18 may be any convenient transmitter of power such as for example a solonoid coil 20, or an electric motor driven cam or a crankshaft for converting rotating motion to reciprocal motion, the energizing power thereto being controlled by trigger 22. The hammer shaft end 24 of shaft 16 is normally spaced from the distal end 26 of housing 12 which is tubular in form to provide a recess to accomodate the upstanding head of strip nail 28.

Figure 4:
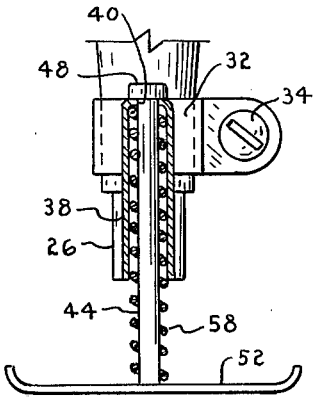
FIG. 4 is a longitudinal section view of the guide runner sectioned along lines 4—4 of FIG. 2.

Connected to housing 12 and forming a part thereof is encapsulating guide means 30 which comprises clamp means 32 provided with screw-nut assembly 34 to more conveniently adjust the position of the guide means 30 on housing 12. Locking key is provided between clamp means 32 and housing 12 to fix the relative position of the clamp means on housing 12 when screw-nut assembly 34 is tightened. Provided on clamp means 32 and forming a part thereof at diametrally spaced positions are sleeve members 36 and 38, one end thereof being open and the other end thereof converging radially inward to form a reduced opening 40 as more clearly shown in FIG. 4. Longitudinally movable in sleeve members 36 and 38 are pintles 42 and 44, respectively, which have diametral dimensions to slidingly fit through reduced openings 40 in sleeve members 36 and 38. Pintles 42 and 44 are provided with caps 46 and 48, respectively, which serve as stops abutting against the radially converging ends of sleeve members 36 and 38. Fixed to the other end of pintles 42 and 44 are guide runners 50 and 52 respectively which are positioned in parallel spaced relation to straddle carpet strip 54. Pintles 42 and 44 are encircled by coil springs 56 and 58 respectively, one end portion thereof fitting within the clearance between the pintles and the sleeve members, the opposite ends thereof abutting against the closed end of sleeve members 36 and 38 formed by the pintle shafts in reduced openings 40 of sleeve members 36 and 38, and slide runners 50 and 52. Coil springs 56 and 58 are normally in slight compression so that the normal position of slide runners 50 and 52 are spaced away from the open end of sleeve members 36 and 38.

Figure 2:
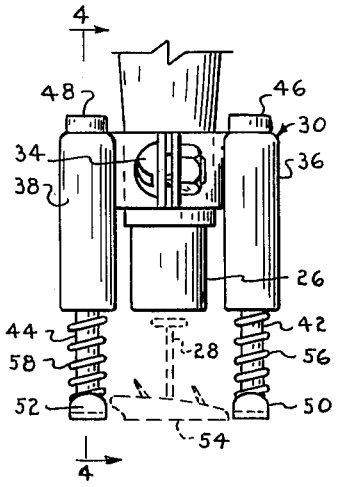
FIG. 2 is a front view of the strip guide and the hammer end of the tool of my invention shown in operative position with the carpet anchor strip shown in dotted lines, the hammer end is shown in fragment.
Figure 5:
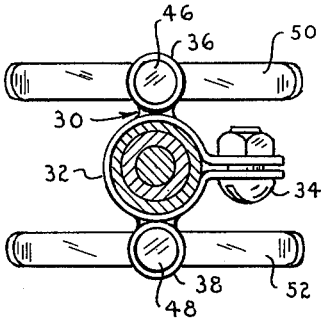
FIG. 5 is a cross section taken along lines 5—5 of Fig. 1 showing the top view of the strip guide of this invention.
Figure 3:
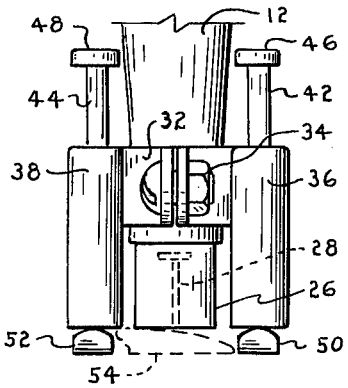
FIG. 3 is that part of my invention shown in FIG. 2 manually pressed down to encapsulate the nail of the carpet strip prior to the hammer blow.

In the operation of my invention, the carpet strips 54 are laid longitudinally end to end adjacent the base board of a wall and parallel thereto. The hammer device 10 of my invention is positioned over the carpet strip so that slide runners 50 and 52 straddle carpet strip 54 as more clearly shown in FIGS. 2 and 4, and located thereover so that the tubular distal end 26 of housing 12 is directly over an upstanding strip nail 28 imbeded in carpet strip 54. The workman then manually presses down on housing 12 against the bias of coil springs 56 and 58 encircling pintles 42 and 44 respectively, thereby encapsulating nail 28 in tubular end 26 of my invention as more clearly shown in FIG. 3 of the drawing. Trigger switch 22 is then activated to electrically energize a driving motor such as solonoid coil 20 to reciprocate hammer shaft 16 with sufficient force to drive nail 28 into the floor. Downward pressure on the hammer device is then removed allowing springs 56 and 58 to bias housing 12 upwardly so that tubular end 26 of housing 12 is raised clear of the barbs and remaining nails of carpet strip 54. The hammer device 10 of my invention is then moved longitudinally along strip 54 on guide runners 50 and 52 until tubular end 26 is positioned over the next anchor nail imbeded in carpet strip 54 and the nailing procedure is repeated until the strips are secured to the floor.

It is obvious that the hammer device 10 of my invention is economical to manufacture and simple to operate. Furthermore, my invention enables a workman to nail carpet anchor strips to the floor to be carpeted easily, quickly and without fatigue.

I claim:

1. A hammer device for driving nails in a carpet strip comprising:

a hammer shaft;

housing means supporting said hammer shaft for reciprocating movement;

drive means for imparting reciprocating movement to said hammer shaft;

a tubular member forming the distal end of said housing means;

sleeve means on said housing means;

elongated means longitudinally movable in said sleeve means;

spaced guide runners for straddling said carpet strip provided at the distal end of said elongated means; and spring means coacting between said sleeve means and said elongated means for biasing said guide runners spaced from said sleeve means.

2. The hammer device of claim 1 wherein said sleeve means on said housing means comprise sleeve members connected to opposite sides of said housing means and the distal ends of said sleeve members being coterminus with the distal end of said tubular member.

3. The hammer device of claim 2 wherein said elongated means longitudinally movable in said sleeve members comprise pintle shafts having caps at one end for abuttment with said sleeve members, and said guide runners being connected to the other ends of said pintle shafts for abuttment against the other end of said sleeve members.

4. In a hammer device for driving nails in a carpet strip, wherein a hammer shaft is supported in a housing for reciprocating movement and drive means being included in said housing for imparting reciprocating movement to said hammer shaft, the combination with said housing of a guide device comprising:

a bracket for clamping onto the distal end of said housing;

sleeve members provided on said bracket at diametral sides thereof;

pintle shafts longitudinally movable through said sleeves;

guide runners connected to the distal ends of said pintle shafts for straddling said carpet strip; and spring means coacting between said guide runners and said sleeve members for biasing said guide runners spaced from said sleeve members.

5. A hammer device for driving nails in a carpet strip comprising:

a reciprocally movable hammer shaft;

a housing for supporting said hammer shaft;

drive means in said housing for imparting reciprocal movement to said hammer shaft;

a tubular member forming the distal end of said housing;

a bracket member connecting said distal end of said housing;

sleeve members on said bracket member at opposite sides thereof;

pintle shafts longitudinally movable through said sleeves;

guide runners connected to the distal ends of said pintle shafts for straddling said carpet strip; and spring means coacting between said guide runners and said sleeve members for biasing said guide runners spaced from said sleeve members.

6. The hammer device of claim 5 wherein said housing and said tubular member forming the distal end of said housing are further characterized as being movable against the bias of said spring means to encapsulate nails upstanding in said carpet strip.

* * * * *